US011196200B2

(12) United States Patent
Hsu et al.

(10) Patent No.: US 11,196,200 B2
(45) Date of Patent: Dec. 7, 2021

(54) ELECTRICAL CONNECTOR ASSEMBLY INCLUDING PLUG AND RECEPTACLE MATING PORTIONS HAVING SPACED FRONT MATING SURFACES

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Kuo-Chun Hsu, New Taipei (TW); Ting-Ting Yin, Kunshan (CN); Zhong-Bao Wu, Kunshan (CN); Cheng-Jun Zou, Kunshan (CN); Bin Peng, Kunshan (CN); Jian-Kuang Zhu, Kunshan (CN); Yu-Jia Deng, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/902,146

(22) Filed: Jun. 15, 2020

(65) Prior Publication Data

US 2020/0395699 A1 Dec. 17, 2020

(30) Foreign Application Priority Data

Jun. 14, 2019 (CN) ..... 201910514892.X

(51) Int. Cl.
*H01R 13/11* (2006.01)
*H01R 12/71* (2011.01)
(Continued)

(52) U.S. Cl.
CPC ..... *H01R 13/113* (2013.01); *H01R 12/71* (2013.01); *H01R 13/055* (2013.01);
(Continued)

(58) Field of Classification Search
CPC .. H01R 13/113; H01R 13/055; H01R 13/502; H01R 13/5219; H01R 13/631; H01R 13/639; H01R 12/727
See application file for complete search history.

(56) References Cited

U.S. PATENT DOCUMENTS 5,256,085 A * 10/1993 Tan ..... H01R 12/716 439/372
6,210,240 B1 * 4/2001 Comerci ..... H01R 12/7088 439/853

(Continued)

*Primary Examiner* — Abdullah A Riyami
*Assistant Examiner* — Nader J Alhawamdeh
(74) *Attorney, Agent, or Firm* — Ming Chieh Chang; Wei Te Chung

(57) ABSTRACT

A plug connector includes an insulative plug housing with a plurality of plug contacts retained thereto. The plug housing forms a plug mating portion with a mating surface thereon. The plug contacts include front blade contacting sections extending beyond the mating surface and are arranged along the first direction with one another. Viewed along the first direction, the mating surface is curved with a bulged middle section. The receptacle connector includes a receptacle housing with a plurality of receptacle contacts retained thereto. The receptacle housing forms therein a mating cavity in which a receptacle mating portion extends along the mating direction wherein the receptacle mating portion forms a mating face behind which the receptacle contacts are located. During mating, the plug mating portion is snugly received within the mating cavity with the mating surface of the plug connector is spaced from the mating face of the receptacle connector.

17 Claims, 9 Drawing Sheets

(51) Int. Cl.
*H01R 13/05* (2006.01)
*H01R 13/502* (2006.01)
*H01R 13/52* (2006.01)
*H01R 13/62* (2006.01)

(52) U.S. Cl.
CPC ..... *H01R 13/502* (2013.01); *H01R 13/5219* (2013.01); *H01R 13/62* (2013.01)

(56) References Cited

U.S. PATENT DOCUMENTS 7,422,451 B2 * 9/2008 Chen ..... H01R 13/652 439/101
7,438,556 B2 * 10/2008 Yi ..... H01R 12/52 439/61
7,802,994 B1 * 9/2010 Chen ..... H01R 12/732 439/65
8,267,724 B2 * 9/2012 Dodds ..... H01R 13/113 439/660
8,398,440 B2 * 3/2013 Dodds ..... H01R 12/724 439/660
8,414,310 B2 * 4/2013 Zhu ..... H01R 24/60 439/74
8,662,932 B2 * 3/2014 Annis ..... H01R 13/629 439/638
8,992,245 B2 * 3/2015 Higuchi ..... H01R 13/5202 439/272
9,178,296 B2 * 11/2015 Funamura ..... H01R 13/74
9,711,897 B2 * 7/2017 Ho ..... H01R 13/113
10,276,972 B1 * 4/2019 Lai ..... H01R 13/5216
10,461,475 B2 * 10/2019 Little ..... H01R 13/6658
2011/0104953 A1 * 5/2011 Dodds ..... H01R 13/53 439/660
2011/0130043 A1 * 6/2011 Chen ..... H01R 12/7047 439/660
2012/0289071 A1 * 11/2012 Dodds ..... H01R 12/724 439/183
2013/0090001 A1 * 4/2013 Kagotani ..... H01R 13/60 439/378
2014/0113493 A1 * 4/2014 Funamura ..... H01R 12/716 439/626
2020/0203870 A1 * 6/2020 Yin ..... H01R 13/113
2020/0335895 A1 * 10/2020 Liu ..... H01R 13/639

* cited by examiner

ELECTRICAL CONNECTOR ASSEMBLY INCLUDING PLUG AND RECEPTACLE MATING PORTIONS HAVING SPACED FRONT MATING SURFACES

BACKGROUND OF THE INVENTION

1. Field of the Invention

The present invention relates generally to an electrical connector assembly, and particularly to an electrical connector assembly composed of a plug connector and a receptacle connector mated with each other in a waterproof condition.

2. Description of Related Arts

U.S. Patent Application Publication No. 2019/0237889 discloses an electrical connector assembly of a circular interface. Anyhow, such an assembly fails to disclose the efficient waterproof function during mating.

It is desired to provide an electrical connector equipped with the efficient waterproof mechanism.

SUMMARY OF THE INVENTION

To achieve the above object, an electrical connector assembly includes a plug connector and a receptacle connector mateable with each other. The plug connector includes an insulative plug housing with a plurality of plug contacts retained thereto. The plug housing forms a plug mating portion with a mating surface thereon. A set of rings is disposed upon the mating portion and located behind the mating surface in the mating direction. The plug contacts include front blade contacting sections extending beyond the mating surface and are arranged along the first direction X with one another. Viewed along the first direction, the mating surface is curved with a bulged middle section. The receptacle connector includes an insulative receptacle housing with a plurality of receptacle contacts retained thereto. The receptacle housing forms therein a mating cavity in which a receptacle mating portion extends along the mating direction wherein the receptacle mating portion forms a mating face behind which the receptacle contacts are located. During mating, via assistance of the set of rings, the plug mating portion is snugly received within the mating cavity with the mating surface of the plug connector is spaced from the mating face in the mating direction.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
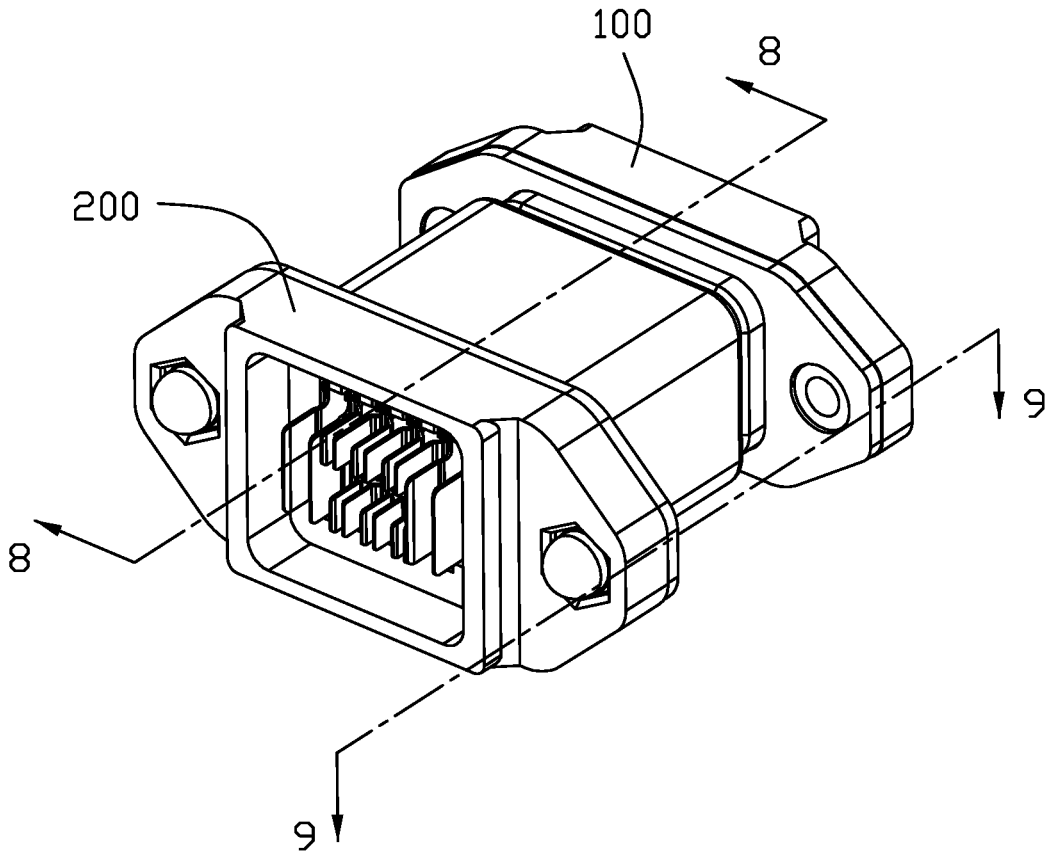
FIG. 1 is a perspective view of the electrical connector assembly according to the present invention.
Figure 2:
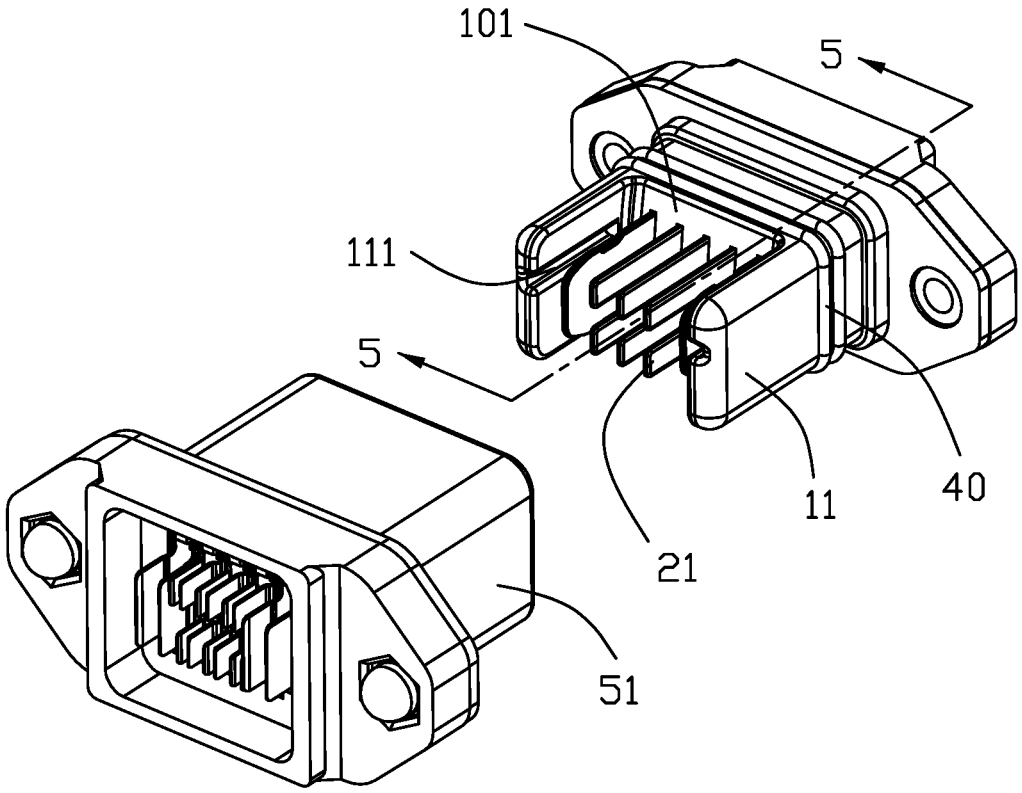
FIG. 2 is an exploded perspective view of the electrical connector assembly of FIG. 1.
Figure 3:
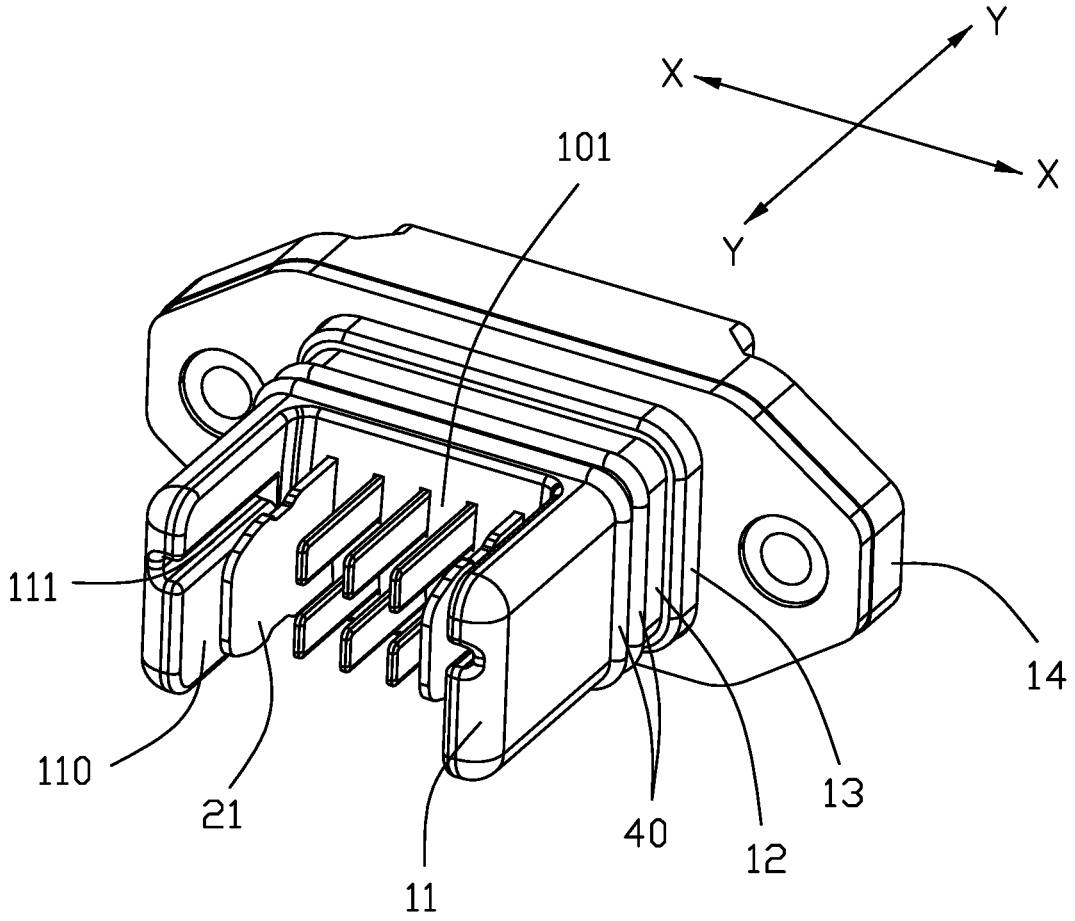
FIG. 3 is a perspective view of the plug connector of the electrical connector assembly of FIG. 1.
Figure 4:
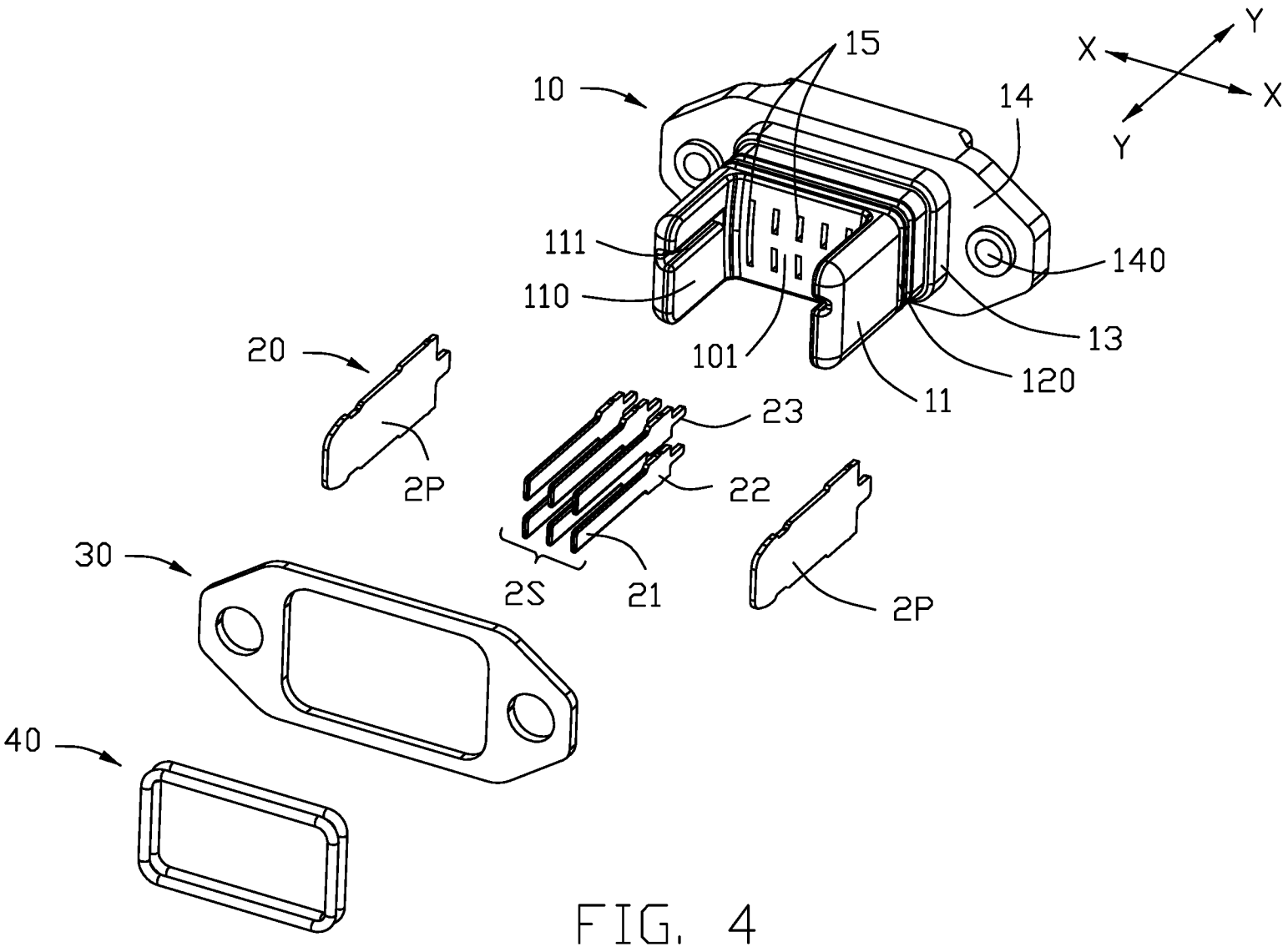
FIG. 4 is an exploded perspective view of the plug connector of the electrical connector assembly of FIG. 3.

Referring to FIGS. 1-9, an electrical connector assembly is composed of a plug connector 100 and a receptacle connector 200 mated with each other along a mating direction, i.e., the front-to-back direction.

The plug connector 100 defines a first direction X, i.e., the longitudinal direction, a second direction Y same with the aforementioned mating direction, and a vertical direction perpendicular to one another. The plug connector 100 includes an insulative plug housing 10 with a plurality of plug contacts 20 retained therein, a metallic shell 30 attached to the plug housing 10, and a set of waterproofing sealing members, i.e., the rings 40.

Figure 5:
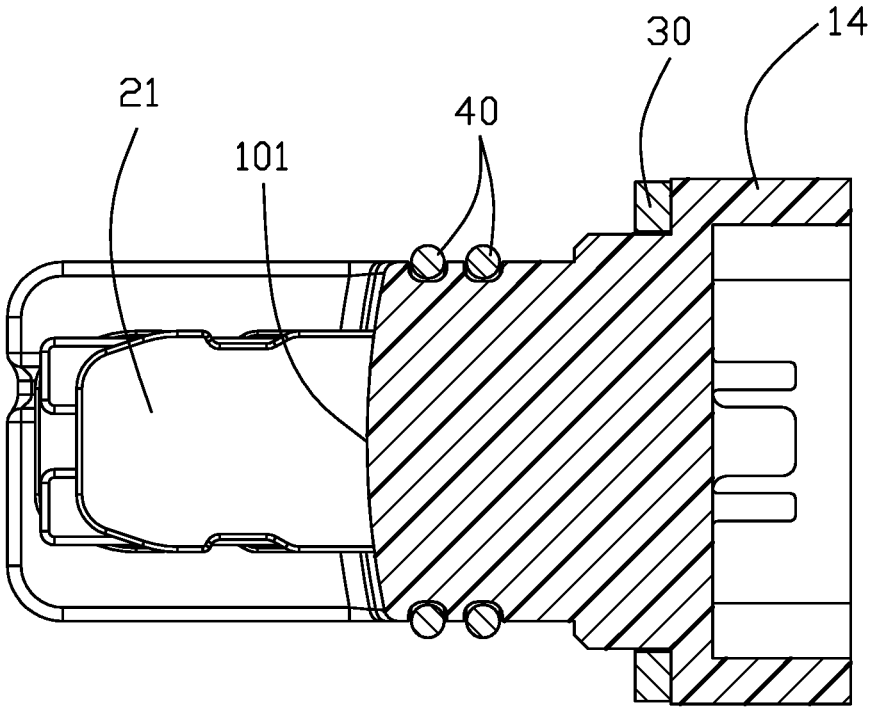
FIG. 5 is a cross-sectional view of the plug connector of the electrical connector assembly of FIG. 3.
Figure 8:
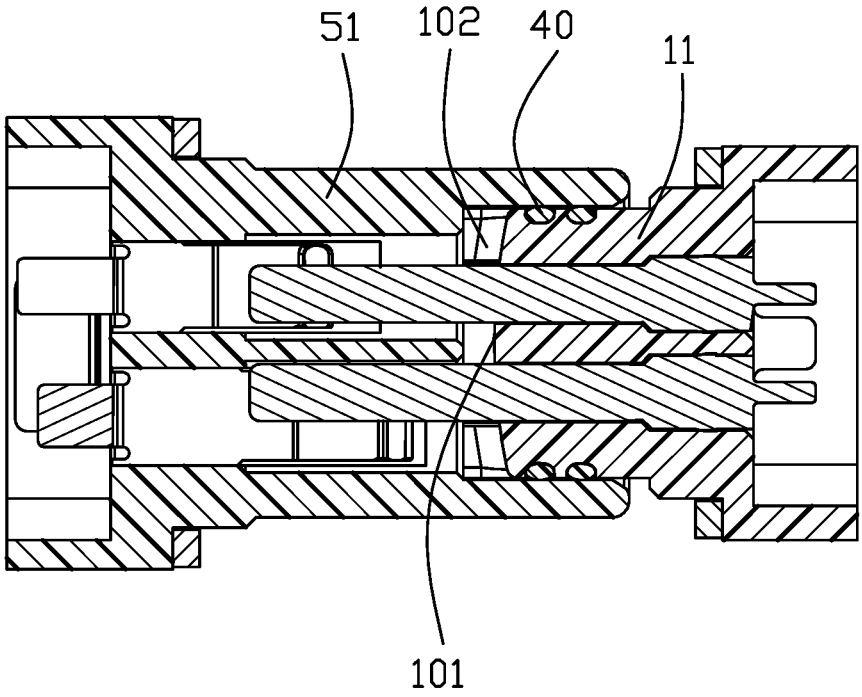
FIG. 8 is a cross-sectional view of the electrical connector assembly of FIG. 1 along line 8-8.

The plug housing 10 includes a plug mating portion 12 with a mating surface 101 thereon. Viewed along the first direction X, the mating surface 101 defines a bulged configuration with a raised middle region, i.e., the middle region being forwardly protruding more than the upper region and the lower region as shown in FIGS. 5 and 8. In detail, the raised distance of the bulged configuration of the mating surface 101 along the mating direction X is around 1 mm Notably, the gap between the mating surface 101 of the plug mating portion 12 and the mating face 501 of the receptacle mating portion 52 mentioned later, is to prevent humidity from invading the passageways 15 of the plug housing 10. The plug mating portion 12 further includes a pair of end walls 11 at opposite ends thereof, and each end wall 11 extends forwardly along the second direction Y. Each the end wall 11 forms an alignment slot 111 in the corresponding interior surface 110. Because the pair of alignment slots 111 is offset from the centerline of each end wall 111, the mating orientation of the plug connector 100 along the mating direction is assured for foolproof. In this embodiment, the alignment slots 111 in the corresponding end wall 11 stops before reaching the mating surface 101, thus providing a space between the mating surface 101 of the plug mating portion 12 and the mating face 502 of the receptacle mating portion 52 for preventing the vacuum effect during mating/un-mating (illustrated later). The plug housing 10 includes a base 13 located between the mounting plate 14 and the plug mating portion 12 in the mating direction Y. A pair of circumferential grooves 120 formed in the exterior surfaces of the plug mating portion 12, receive the set of waterproofing sealing members 40, respectively. The shell 30 is attached upon the front face of the mounting plate 14 with an opening through which the base 13 and the mating portion 12 extend in the mating direction Y. A pair of mounting holes 140 are formed in the mounting plate 14 and in alignment with the corresponding through holes (not labeled) of the shell 30.

The passageways 15 extend through the mating portion 12, the base 13 and the mounting plate 14 in the mating direction Y. The plug contacts 20 are respectively disposed in the corresponding passageways 15, respectively. Each plug contact 20 includes a blade type contacting section 21, a retaining section 22 retained in the corresponding passageway 15, and a soldering section 23 exposed behind the mounting plate 14. The contacting sections 21 of the plug contact 20 extend forwardly beyond the mating surface 101 and arranged along the first direction X with one another. The plug contacts 20 includes two power contacts 2P and two sets of signal contacts 2S. the power contact 2P is larger than the signal contact 2S. There are two sets of signal contacts 2S spaced from each other in the vertical direction while each set of signal contacts are spaced from one another along the first direction X. The two sets of signal contacts 2S are located between two power contacts 2P in the first direction X. The power contact 2P extends further forwardly in the mating direction Y compared with the signal contact 2S.

Figure 9:
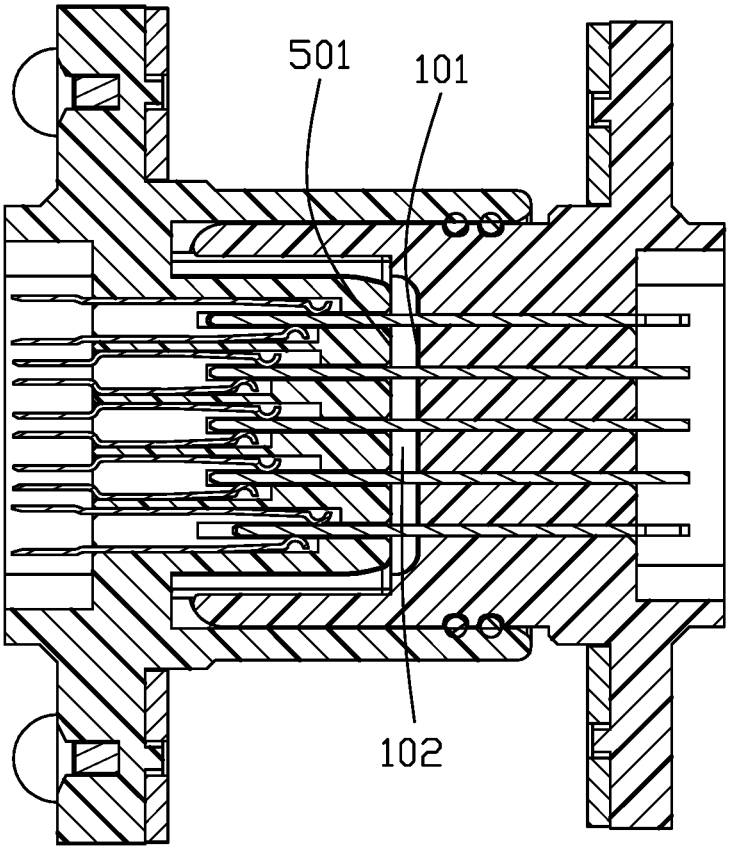
FIG. 9 is a cross-sectional view of the electrical connector assembly of FIG. 1 along line 9-9.

The receptacle connector 200 includes an insulative receptacle housing 50 with a plurality of receptacle contacts 60 retained to thereto, and a metallic shell 70 attached upon the receptacle housing 50. The insulative receptacle housing 50 includes a base 53, and a circumferential wall 51 extending forwardly from the base 53 in the mating direction Y. A mating cavity 501 is formed within the circumferential wall 51, and a receptacle mating portion 52 extends forwardly from the base 53 into the mating cavity 501. During mating, the plug mating portion 12 including the pair of end walls 11 is received within the mating cavity 501. Because the sealing members 40 tightly abut against the interior surfaces of the circumferential wall 51, a waterproofing effect is achieved. Notably, the receptacle mating portion 52 forms a pair of alignment ribs 520 to be received within the corresponding alignment slots 111, respectively. As mentioned before, the alignment slot 111 is stopped before reaching the mating surface 101 of the plug mating portion 12, the mating surface 101 of the plug mating portion 12 is spaced from the mating face 502 of the receptacle mating portion 52 in the mating direction for providing an anti-vacuum space 102 therebetween as shown in FIG. 9. Understandably, such a space 102 may avoid vacuum effect during withdrawal of the plug mating portion 12 of the plug connector 100 from the mating cavity 501 of the receptacle connector 200.

Figure 6:
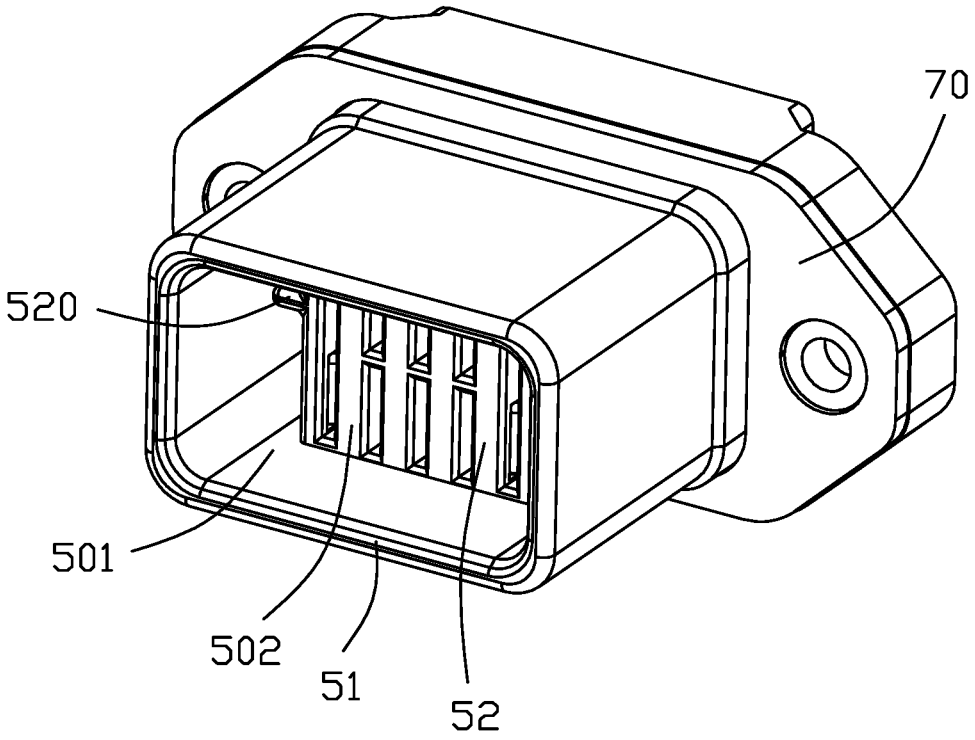
FIG. 6 is a perspective view of the receptacle connector of the electrical connector assembly of FIG. 1.
Figure 7:
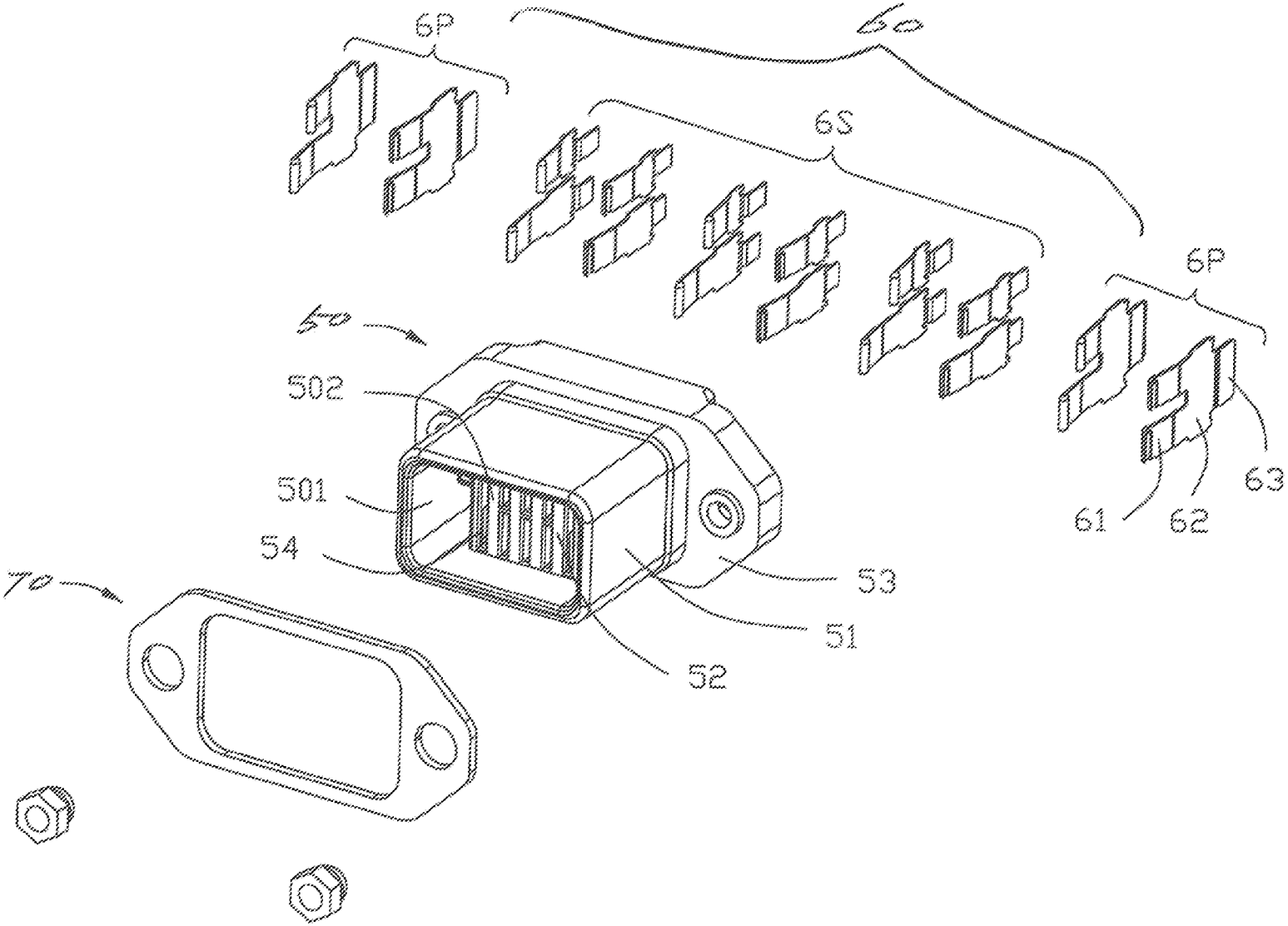
FIG. 7 is an exploded perspective view of the receptacle connector of the electrical connector assembly of FIG. 1.

Referring to FIG. 6, the receptacle contacts 60 are received within the receptacle mating portion 52 and include two power contacts 6P for mating with the power contacts 2P, the sets of receptacle contacts 6S for mating with the sets of signal contacts 2S. Similar to the plug contact 20, the receptacle contact 60 includes a front contacting section 61 for mating with the corresponding mating section 21 of the plug contact 20, a retaining section 62 for retaining to the receptacle housing 50, and a soldering section 63. The sets of receptacle contacts 60 are spaced from each other another along the second direction Y while each set if receptacle contacts 60 are arranged along the first direction X with one another.

In brief, one feature of the invention is to provide the space between the mating surface of the plug mating portion and the mating face of the receptacle mating portion for avoiding the vacuum effect during withdrawal of the plug connector from the receptacle connector. The space is not more than 2 mm. Another feature of the invention is to provide the bulged/protruding middle region on the mating surface/face for forming the tiny space between the mating surface of the plug mating portion and the mating face of the receptacle mating portion. In this embodiment, the bulged region is located at the middle region between two rows of the contacts in the vertical direction. Another feature of the invention is to provide two spaced sealing members 40 around the root of the plug mating portion compared with the single sealing member. Those mechanisms may optimize waterproofing effect either alone or in combination.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly comprising:

a plug connector and a receptacle connector mateable with each other along a front-to-back direction, said plug connector including an insulative plug housing with a plurality of plug contacts retained therein, the plug housing forming a plug mating portion with a front mating surface thereon, the plug contacts including corresponding plug mating sections extending forwardly beyond the mating surface in the front-to-back direction;

said receptacle connector including an insulative receptacle housing with a plurality of receptacle contacts contained therein, the receptacle housing including a circumferential wall forming a mating cavity with a receptacle mating portion extending along the front-to-back direction in the mating cavity, the receptacle mating portion forming a front mating face thereon, the receptacle contacts including corresponding receptacle mating sections located behind the mating face in the front-to-back direction; wherein during mating, the plug mating portion is received within the mating cavity and the plug mating sections of the plug contacts are mated with the receptacle mating sections of the corresponding receptacle contacts, respectively; wherein the front mating surface of the plug mating portion is spaced, along the front-to-back direction, from the front mating face of the receptacle mating portion with a space.

2. The electrical connector assembly as claimed in claim 1, wherein said distance is not more than 2 mm.

3. The electrical connector assembly as claimed in claim 1, wherein one of said front surface of the plug mating portion and the front face of the receptacle mating portion forms a bugled configuration.

4. The electrical connector assembly as claimed in claim 3, wherein said bulged configuration is derived from a raised middle region in a vertical direction perpendicular to the front-to-back direction.

5. The electrical connection assembly as claimed in claim 4, wherein both the plug contacts and the receptacle contacts are arranged in two rows each extending along a longitudinal direction perpendicular to both the front-to-back direction and the vertical direction, and the raised middle region is located between said two rows in the vertical direction.

6. The electrical connector assembly as claimed in claim 1, wherein the plug mating portion includes a pair of end walls sandwiched between the circumferential wall and the receptacle mating portion of the receptacle housing in a longitudinal direction perpendicular to the front-to-back direction.

7. The electrical connector assembly as claimed in claim 6, wherein one of the circumferential wall and the pair of end walls forms an alignment rib, and the other of the circumferential wall and the pair of the end walls forms an alignment slot receiving said alignment rib therein.

8. The electrical connector assembly as claimed in claim 7, wherein a front end of the alignment rib is stopped by a rear end of the alignment slot so as to leave said space between the front mating surface of the plug mating portion and the front mating face of the receptacle mating portion.

9. The electrical connector assembly as claimed in claim 8, wherein said alignment slot is formed in one of said pair of end walls, and the rear end of said alignment slot is stopped before reaching the front mating surface of the plug mating portion.

10. The electrical connector assembly as claimed in claim 9, wherein said alignment rib is formed on the receptacle mating portion, and the front end of the alignment rib is coplanar with the front mating face of the receptacle mating portion.

11. The electrical connector assembly as claimed in claim 1, wherein the plug connector further includes at least one sealing member attached upon a circumferential exterior surface of a root region of the plug mating portion so as to abut against a front portion of a circumferential interior surface of said circumferential wall of the receptacle housing.

12. A plug connector for mating with a receptacle connector having a circumferential wall defining a mating cavity with a receptacle mating portion extending therein, comprising:

an insulative plug housing with a plurality of plug contacts retained therein, the plug housing forming a plug mating portion with a front mating surface thereon, the plug contacts including corresponding plug mating sections extending forwardly beyond the mating surface in a front-to-back direction; wherein the front mating surface defines a bulged configuration for forming a space with the receptacle mating portion in the front-to-back direction during mating along said front-to-back direction.

13. The plug connector as claimed in claim 12, wherein the bulged configuration defines a raised middle region in a vertical direction perpendicular to both the front-to-back direction and a longitudinal direction along which said plug contacts are arranged in at least one row.

14. The plug connector as claimed in claim 13, wherein said plug contacts are arranged in two rows, and the middle region is located between said two rows in said vertical direction.

15. The plug connector as claimed in claim 12, wherein said plug mating portion further includes a pair of end walls spaced from each other along a longitudinal direction perpendicular to the front-to-back direction, and the plug mating sections are located between the pair of end walls in the longitudinal direction.

16. The plug connector as claimed in claim 15, wherein an interior surface of each of said end walls forms an alignment slot which is stopped before reaching the front mating surface with a distance in the front-to-back direction.

17. The plug connector as claimed in claim 12, further including at least one sealing member attached upon a circumferential exterior surface of a root region of the plug mating portion.

* * * * *